United States Patent [19]

Liebermann

[11] 4,177,856

[45] * Dec. 11, 1979

[54] CRITICAL GAS BOUNDARY LAYER REYNOLDS NUMBER FOR ENHANCED PROCESSING OF WIDE GLASSY ALLOY RIBBONS

[75] Inventor: Howard H. Liebermann, Schenectady, N.Y.

[73] Assignee: General Electric Company, Schenectady, N.Y.

[ * ] Notice: The portion of the term of this patent subsequent to Mar. 20, 1996, has been disclaimed.

[21] Appl. No.: 937,113

[22] Filed: Aug. 28, 1978

[51] Int. Cl.[2] ..... B22D 11/06; B22D 11/16

[52] U.S. Cl. ..... 164/87; 164/423

[58] Field of Search ..... 164/82, 87, 423, 427; 264/164, 165, 176 F

[56] References Cited

U.S. PATENT DOCUMENTS

| | | | |
|---|---|---|---|
| 3,881,540 | 5/1975 | Kavesh | 164/87 |
| 3,881,542 | 5/1975 | Polk et al. | 164/87 |
| 4,144,926 | 3/1979 | Liebermann | 164/87 |

FOREIGN PATENT DOCUMENTS 2719710 11/1977 Fed. Rep. of Germany ..... 164/423

OTHER PUBLICATIONS

Chen et al., "Centrifugal Spinning of Metallic Glass Filaments" *Mat. Res. Bull.,* vol. 11, pp. 49–54, 1976.

Liebermann et al., "Production of Amorphous Alloy Ribbons and Effects of Apparatus Parameters on Ribbon Dimensions," I.E.E.E. Trans., Mag–12, pp. 921–926, 1976.

Kavesn. *Metallic Glasses,* A.S.M., Chapter 2, 1978 pp. 36–72.

*Primary Examiner*—Robert D. Baldwin
*Assistant Examiner*—Gus T. Hampilos
*Attorney, Agent, or Firm*—Donald M. Winegar; Joseph T. Cohen; Leo I. MaLossi

[57] ABSTRACT

A critical gas boundary layer Reynolds number has been defined to indicate processing conditions under which wide glassy alloy ribbons result when processing under various gaseous atmospheres and pressures and casting onto a moving substrate at an impingement angle $\alpha$.

3 Claims, 2 Drawing Figures

CRITICAL GAS BOUNDARY LAYER REYNOLDS NUMBER FOR ENHANCED PROCESSING OF WIDE GLASSY ALLOY RIBBONS

BACKGROUND OF THE INVENTION

1. Field of the Invention

This invention relates to the production of wide glassy alloy ribbons by chill block melt-spinning and in particular to the critical gas boundary layer Reynolds number above which wide glassy alloy ribbons with serrated edges and surface perforations result when cast at an impingement angle $\alpha$.

2. Description of the Prior Art

Relationships between processing parameters and dimensions of glassy alloy ribbons formed by melt-spinning have been discussed by Chen and Miller in Material Research Bulletin 11, 49 (1976), Liebermann and Graham, Jr., I.E.E.E. Transactions Mag-12, No. 6, 921(1976) and Kavesh, Metallic Glasses, ed. J.J. Gilman, A.S.M. (1978), Ch. 2. However, the nature of the gas boundary layer associated with the motion of the substrate wheel and its effects on the melt puddle and resultant ribbon geometry have not been quantitatively considered in the literature. Although relatively narrow glassy alloy ribbons may be cast satisfactorily without special care regarding the prevalent atmosphere in which melt-spinning is conducted, the fabrication of wider ribbons with good surface finish and smooth edge is found to be difficult or impossible without controlling the gas boundary layer on the circumferential surface of the rotating substrate wheel. Failure to control this boundary layer typically results in ribbons with serrated edges and possible longitudinal slits.

It is therefore an object of this invention to provide a new and improved method for processing wide glassy alloy ribbons.

Another object of this invention is to provide a new and improved method for processing glassy alloy ribbons wherein substantially higher than prior art substrate speeds are employed in the manufacture of very thin wide ribbons.

A further object of this invention is to provide a new and improved method for processing wide glassy alloy ribbons embodying a critical gas boundary layer Reynolds number for developing parameters when casting at an impingement angle $\alpha$.

BRIEF DESCRIPTION OF THE INVENTION

In accordance with the teachings of this invention there is provided a method for producing glassy wide alloy ribbons. The method includes controlling the thin gas boundary layer established on the rapidly moving substrate surface immediately adjacent to the melt puddle from which the ribbon is produced. The melt puddle is produced by impinging a molten alloy jet onto the circumferential surface of a rotating substrate wheel of diameter D at an impingement angle $\alpha$ between the melt jet and the tangent to the substrate surface at the impingement point. The substrate wheel speed S, the melt jet velocity v, the ribbon width w, the impingement angle $\alpha$ and the ambient atmospheric gas pressure P are adjusted to result in a gas boundary layer Reynolds number of about $2000 \pm 100$. The gas boundary layer Reynolds number is empirically found to follow the relation:

$$Re = K(1-\cos\alpha)DSwP[\overline{M}/\eta]$$

Re = Reynolds number

K = constant which takes into consideration all conversion factors to obtain dimensional consistency $\alpha$ = impingement angle between melt jet and tangent to substrate surface at point of impingement D = substrate wheel diameter S = substrate wheel speed w = ribbon or puddle width P = ambient atmospheric pressure under which casting is conducted $\overline{M}$ = molecular weight of ambient gas in which casting is conducted $\eta$ = viscosity (20° C.) of ambient gas in which casting is conducted The value of K is $2.868 \times 10^{-8}$ when D and w are each expressed in centimeters, S is expressed in revolutions per minute, P is expressed in millimeters of mercury, $\overline{M}$ is expressed in grams per gram-mole, and $\eta$ is expressed in poise.

DESCRIPTION OF THE INVENTION

It has been discovered that in the casting of glassy alloy ribbons (commonly referred to as amorphous ribbons) under various atmospheric gases and pressures using various processing conditions, ribbon edge deterioration invariably occurred at gas boundary layer Reynolds numbers of $>2000 \pm 100$ and is not exclusively dependent on ribbon width. The various gases in which the ribbon has been cast include helium, air, carbon monoxide, argon, krypton and xenon.

The Reynolds number of the gas boundary layer interacting with the melt puddle made when the melt jet is cast at an impingement angle of 90° with the tangent to the substrate surface is expressed as follows:

$$Re' = KDSwP[\overline{M}/\eta] \quad \text{(I)}$$

where

Re' = Reynolds number

K = constant which takes into consideration all conversion factors to obtain dimensional consistency D = substrate wheel diameter S = substrate wheel speed w = ribbon (puddle) width P = ambient atmospheric pressure under which casting is conducted $\overline{M}$ = molecular weight of ambient gas in which casting is conducted $\eta$ = viscosity (20° C.) of ambient gas in which casting is conducted When the combination of processing parameters shown in equation (I) is such that the ribbon geometry is on the verge of degradation, the Reynolds number is said to go critical. That is, $$Re'^{crit} \simeq 2000 \quad \text{(II)}$$

Preferably, $Re' < \sim 2000 \pm 100$ in order that ribbon edge deterioration and surface perforations are avoided and the product is useable for product manufacture.

A thin boundary layer in which the gas molecules essentially move with the same velocity as the casting surface of a substrate wheel upon which a melt is cast is established because of frictional forces between the substrate surface and the adjacent gas molecules. It is the nature of this thin boundary layer and its interaction with the alloy melt puddle, from which glassy alloy ribbon is continuously drawn, which determines whether or not serrated ribbon edges and surface perforations will occur under a given set of casting conditions.

Figure 1:
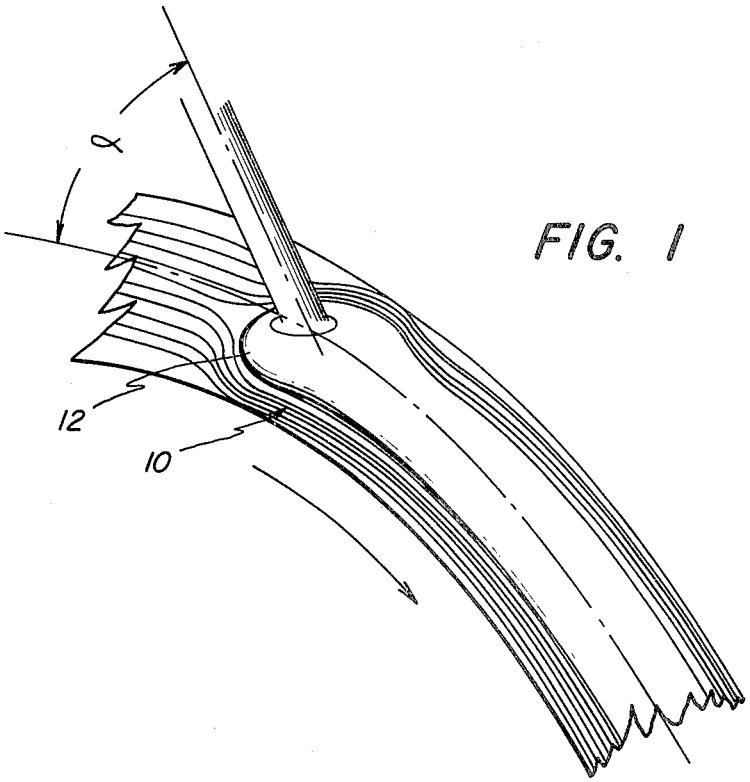
FIG. 1 is a schematic of ribbon formation with gas boundary Reynolds number less than a critical value $Re^{crit}$.
Figure 2:
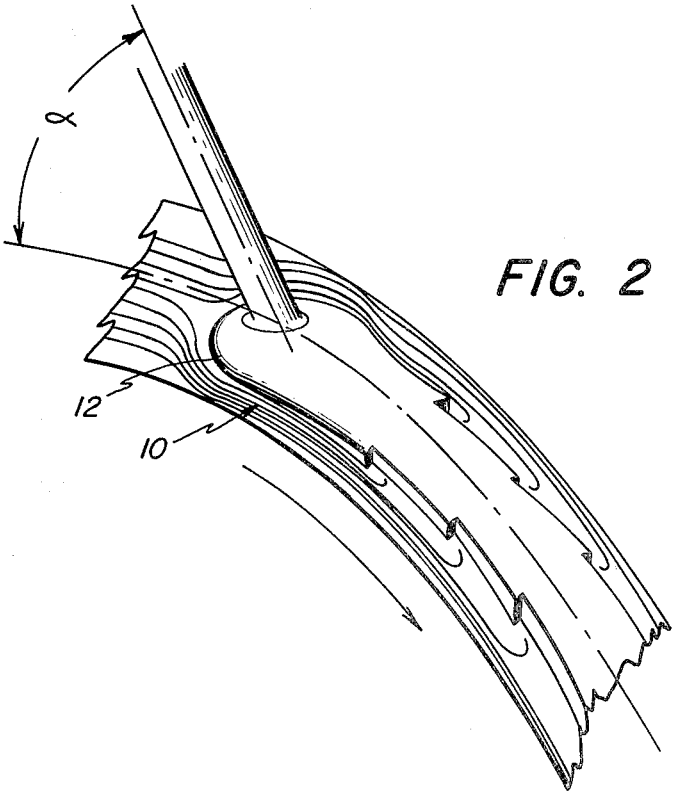
FIG. 2 is a schematic of ribbon formation with gas boundary layer Reynolds number greater than a critical value $Re^{crit}$.

With reference to FIG. 1 a melt is cast onto a moving substrate at an impingement angle $\alpha$. The thin gas boundary layer 10 following the moving substrate surface 12 and immediately adjacent to the melt puddle at its interface with the substrate surface 12 does not adversely affect changes in the melt puddle width. The thin gas flow boundary layer 10 remains nonturbulent for a gas boundary layer Reynolds number Re less than some critical value $Re^{crit}$. Referring now to FIG. 2, turbulence occurs in the thin boundary layer 10 when $Re > Re^{crit}$ and modulates melt puddle width, thereby causing serrated edges.

The gas boundary layer Reynolds number appears to follow the relationship:

$$Re' = vw/\nu \qquad \text{(III)}$$

wherein $Re'$ = the Reynolds number v = gas velocity (assumed equal to substrate surface velocity)

w = ribbon width (assumed equal to melt puddle width at interface with the substrate wheel)

$\nu = \eta/\rho$ = kinematic gas viscosity and $\eta$ = static gas viscosity $\rho$ = gas density Assuming ideal gas behavior, $$\rho = n\overline{M}/V = P\overline{M}/RT \qquad \text{(IV)}$$

wherein n = moles of gas $\overline{M}$ = gas molecular weight

V = gas volume

P = gas pressure

R = ideal gas constant

T = gas temperature by substitution:

$$Re' = [vwP/RT]\cdot[\overline{M}/\eta] \qquad \text{(V)}$$

The first of the two factors of equation (V) relates exclusively to physically variable apparatus and processing parameters. The second factor of equation (V) is a physical constant particular to the gas in which the melt-spinning in conducted. The following Table records the physical constant and propensity for serrated edge formation for various gases, all of which have been used in melt-spinning experiments except for $H_2$ and Ne.

TABLE

| GAS | He | $H_2$ | Ne | Air | CO | Ar | $CO_2$ | Kr | Xe |
|---|---|---|---|---|---|---|---|---|---|
| $10^{-4}\ \frac{\overline{M}}{\eta}$ | 2.06 | 2.30 | 6.49 | 15.8 | 16.0 | 18.1 | 29.7 | 34.1 | 58.1 |

order of increased propensity for serrated ribbon edge formation

---------- >

Ribbon edge deterioration occurs abruptly at $Re' = \sim 2000$. Ribbon edge surface deterioration is intensified with an increasing gas boundary layer Reynolds number.

The impingement angle dependence of gas boundary layer Reynolds number has been determined by casting ribbons of various widths at fixed melt jet impingement angles $\alpha$, all other processing conditions held constant. This work results in the approximate expression:

$$Re = (K)(1 - \cos\alpha)DSwP(\overline{M}/\eta) \qquad \text{VI}$$

where

K = constant which takes into consideration all conversion factors to obtain dimensional consistency and $K = 2.868 \times 10^{-8}$ when D and w are expressed in centimeters, S is expressed in revolutions per minute, P is expressed in millimeters of mercury, $\overline{M}$ is expressed in gram per gram mole, and $\eta$ is expressed in poise.

As previously stated in copending U.S. Patent Application, Ser. No. 896,752, and now U.S. Pat. No. 4,144,926, the critical gas boundary layer Reynolds number above which serrated ribbon edges result is $2000 \pm 100$. Equation VI has been verified for various combinations of processing parameter values.

Although glassy alloy ribbon has been cast with $10° \leqq \alpha \leqq 100°$, the preferred range of operation is $40° \leqq \alpha \leqq 70°$ because of ribbon geometry problems occurring at either extreme. Aside from the serrated edges which may be found to occur at any $\alpha$, casting at $\alpha < 70°$ typically imparts surface roughness and "fluid flow marks" on the ribbon free surface, thereby making the product undesirable. Casting at $\alpha < \sim 40°$ results in rapid thickening of the sample with decreasing angle and can conceivably be the source of some ribbon thickness variations. Of course, sample thickening must be counteracted by reduced melt flow rate and/or increased substrate surface speed, both of which are undesirable. Finally, experiments with round melt jet impinged at $\alpha < \sim 40°$ have revealed ribbons with excessively non-uniform thickness across the width of the sample.

EXAMPLE I

A glassy alloy ribbon of nominal composition $Fe_{40}Ni_{40}B_{20}$ 3.5 millimeters in width was produced by casting from a clear fused quartz crucible with a 20 mil round orifice and melt ejection pressure of 80 psi directed at an angle $\alpha = 40°$ impingement onto the surface of a copper substrate wheel 7.5 centimeters in diameter rotating at a speed of 8000 revolutions per minute. The ambient atmosphere was air at 760 millimeters mercury pressure. The gas boundary layer Reynolds number, Re, as determined from equation VI was 1700. The ribbon edges were smooth and both the top and bottom surfaces were of excellent quality.

EXAMPLE II

The process of Example I was repeated except that the impingement angle was 90°. The ribbon produced was amorphous material and had good surface and edge qualities. However, the width of the ribbon was only approximately 1 mm.

By employing the teachings of this invention and having the critical values for the gas boundary flow Reynolds number, Re, one is able to readily make good wide glassy alloy ribbon material. Glassy alloy ribbons in systems such as Fe-B, Fe-B-C, Fe-Ni-B, Fe-B-Si, Nb-Ni, Cu-Ti, Ni-Zr and Cu-Zr are successfully cast with smooth edges when the processing parameters conform to the limitations expressed in Formula (I).

I claim as my invention:

1. A method for producing wide glassy alloy ribbons including the process steps of (a) casting a melt of a glassy metal alloy onto a surface wheel having a wheel diameter D and at a predetermined impingement angle $\alpha$ therewith;

(b) adjusting the substrate wheel speed S and the melt jet velocity to form a melt puddle of width w on the substrate wheel surface;

(c) adjusting the prevalent ambient atmospheric pressure to a predetermined value, (d) producing a glassy alloy ribbon from the melt puddle, and (e) maintaining the Reynolds number Re for the gas boundary layer flow about the melt puddle at less than a critical value $Re^{crit}$ of about 2000±100 whereby the Reynolds number Re is expressed by the following formula $$Re=K(1-\cos\alpha)DSwP[\overline{M}/\eta]$$

wherein

Re=Reynolds number

K=constant which takes into consideration all conversion factors to obtain dimensional consistency $\alpha$=impingement angle between the melt jet and the tangent to the substrate surface at the impingement point D=substrate wheel diameter S=substrate wheel speed w=ribbon or puddle width P=ambient atmospheric pressure under which casting is conducted $\overline{M}$=molecular weight of ambient gas in which casting is conducted $\eta$=viscosity (20° C.) of ambient gas in which casting is conducted.

2. The method of claim 1 wherein $$K=2.868\times10^{-8}$$

when D and w are expressed in centimeters, S is expressed in revolutions per minute, P is expressed in millimeters of mercury, M is expressed in gram per mole, and $\eta$ is expressed in poise.

3. The method of either claims 1 or 2 wherein the impingement angle $\alpha$ may vary from 40° to 70°.

* * * * *